US008202235B2

(12) United States Patent
Huang

(10) Patent No.: US 8,202,235 B2
(45) Date of Patent: Jun. 19, 2012

(54) SINGLE-MOTOR MASSAGER

(76) Inventor: Chien-Ming Huang, Taipei (TW)

( * ) Notice: Subject to any disclaimer, the term of this patent is extended or adjusted under 35 U.S.C. 154(b) by 396 days.

(21) Appl. No.: 12/655,292

(22) Filed: Dec. 28, 2009

(65) Prior Publication Data

US 2011/0160627 A1 Jun. 30, 2011

(51) Int. Cl.
*A61H 19/00* (2006.01)
*A61H 7/00* (2006.01)
*A61H 15/00* (2006.01)

(52) U.S. Cl. ..... 601/103; 601/98; 601/112; 601/101

(58) Field of Classification Search ..... 601/84, 601/97, 98, 101–103, 112, 118, 126, 128, 601/134

See application file for complete search history.

(56) References Cited

U.S. PATENT DOCUMENTS 5,462,516 A * 10/1995 Anderson ..... 601/99
2008/0077061 A1* 3/2008 Dehli ..... 601/118
2009/0270777 A1* 10/2009 Wu et al. ..... 601/87

* cited by examiner

*Primary Examiner* — Nicholas Lucchesi
*Assistant Examiner* — Leah Stohr
(74) *Attorney, Agent, or Firm* — William E. Pelton, Esq.; Cooper & Dunham LLP

(57) ABSTRACT

A single-motor massager has a housing, a carriage and a lead threaded rod mounted in the housing, a guiding assembly, two transmission assemblies and a driving assembly mounted in the carriage, and two massage assemblies respectively driven by the transmission assemblies. The lead threaded rod has a right-handed thread and a left-handed thread so the carriage moves back and forth along the lead threaded rod and the massage assemblies can massage a large area of an operator's back. One of the transmission assembly has a one-way bearing so the carriage is able to stop at any position of the lead threaded rod and the massage assemblies are able to focus on a massage function at a specific position.

16 Claims, 11 Drawing Sheets

SINGLE-MOTOR MASSAGER

BACKGROUND OF THE INVENTION

1. Field of the Invention

The present invention relates to a massager, especially to a massager driven by only one motor.

2. Description of the Prior Art(s)

Massagers, especially body massagers, provide a kneading or vibrating function, or both to simulate massage and relax an operator.

With reference to FIG. 11, a conventional massager (90) has a massage assembly (91) connected to a threaded shaft (92) through a gear set. A first motor (93) is disposed on and rotates the threaded shaft (92) and controls the massage assembly (91) to move back and forth along the threaded shaft (92) or to stop at a specific position of the threaded shaft (92). A second motor (94) is disposed in and drives the massage assembly (91) so the massage assembly (91) provides massage functions. Therefore, the conventional massager (90) with two motors (93, 94) is bulky and high cost.

Another conventional massager has a massage assembly, a rack, a gear set connected between the massage assembly and the rack and a motor driving the gear set so the massage assembly provides massage functions and moves back and forth along the rack simultaneously. However, this conventional massager is unable to stop at a specific position of the rack to focus on the massage functions at a specific position.

To overcome the shortcomings, the present invention provides a single-motor massager to mitigate or obviate the aforementioned problems.

SUMMARY OF THE INVENTION

The main objective of the present invention is to provide a single-motor massager that has a housing, a carriage and a lead threaded rod mounted in the housing, a guiding assembly, two transmission assemblies and a driving assembly mounted in the carriage, and two massage assemblies respectively driven by the transmission assemblies.

The lead threaded rod has a right-handed thread and a left-handed thread so the carriage moves back and forth along the lead threaded rod and the massage assemblies can massage a large area of an operator's back.

One of the transmission assembly has a one-way bearing so the carriage is able to stop at any position of the lead threaded rod and the massage assemblies are able to focus on a massage function at a specific position.

Other objectives, advantages and novel features of the invention will become more apparent from the following detailed description when taken in conjunction with the accompanying drawings.

BRIEF DESCRIPTION OF THE DRAWINGS

FIG. 5 is an enlarged side view in partial section of the

DETAILED DESCRIPTION OF THE PREFERRED EMBODIMENTS

Figure 1:
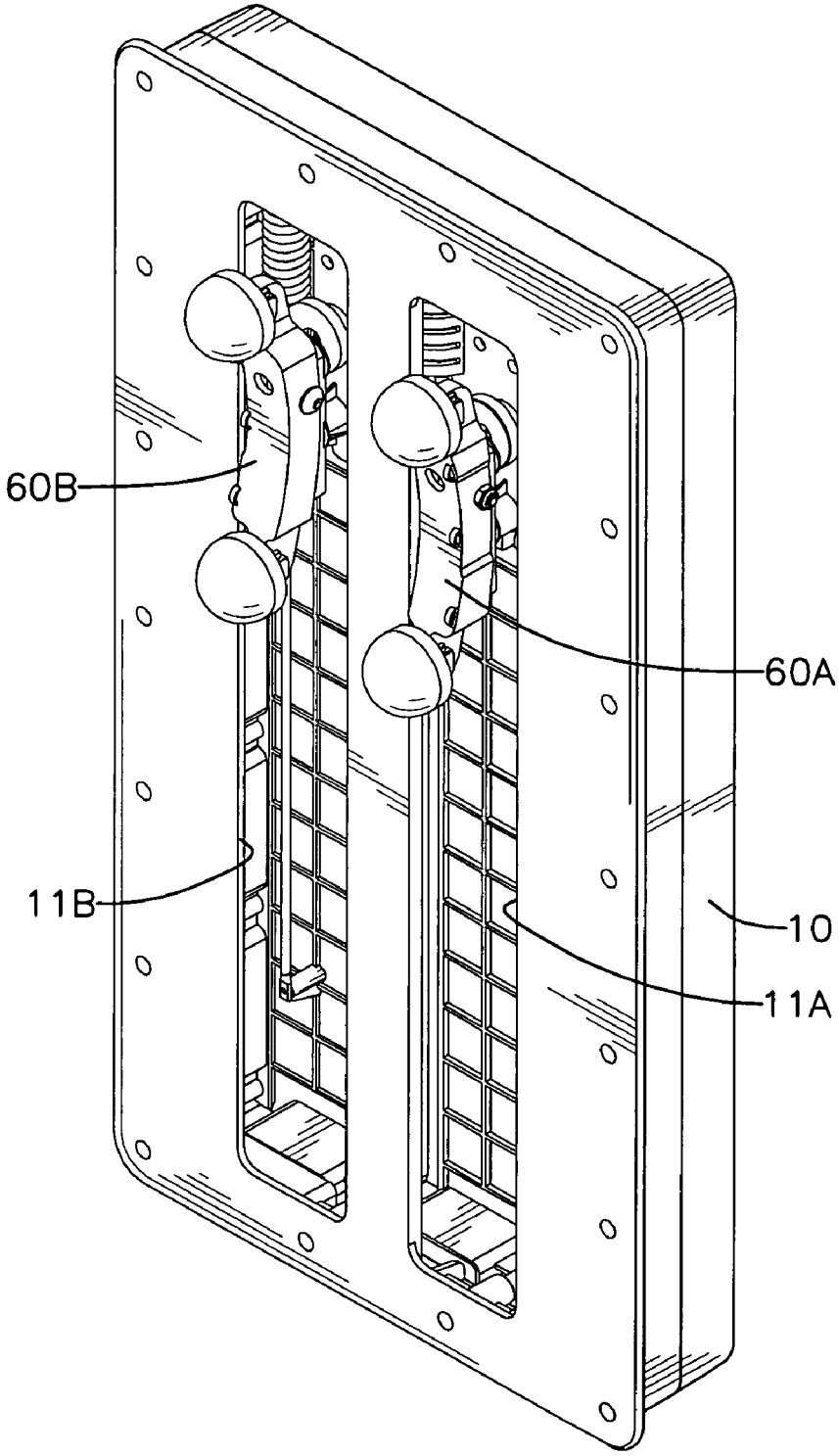
FIG. 1 is a perspective view of a single-motor massager in accordance with the present invention.
Figure 2:
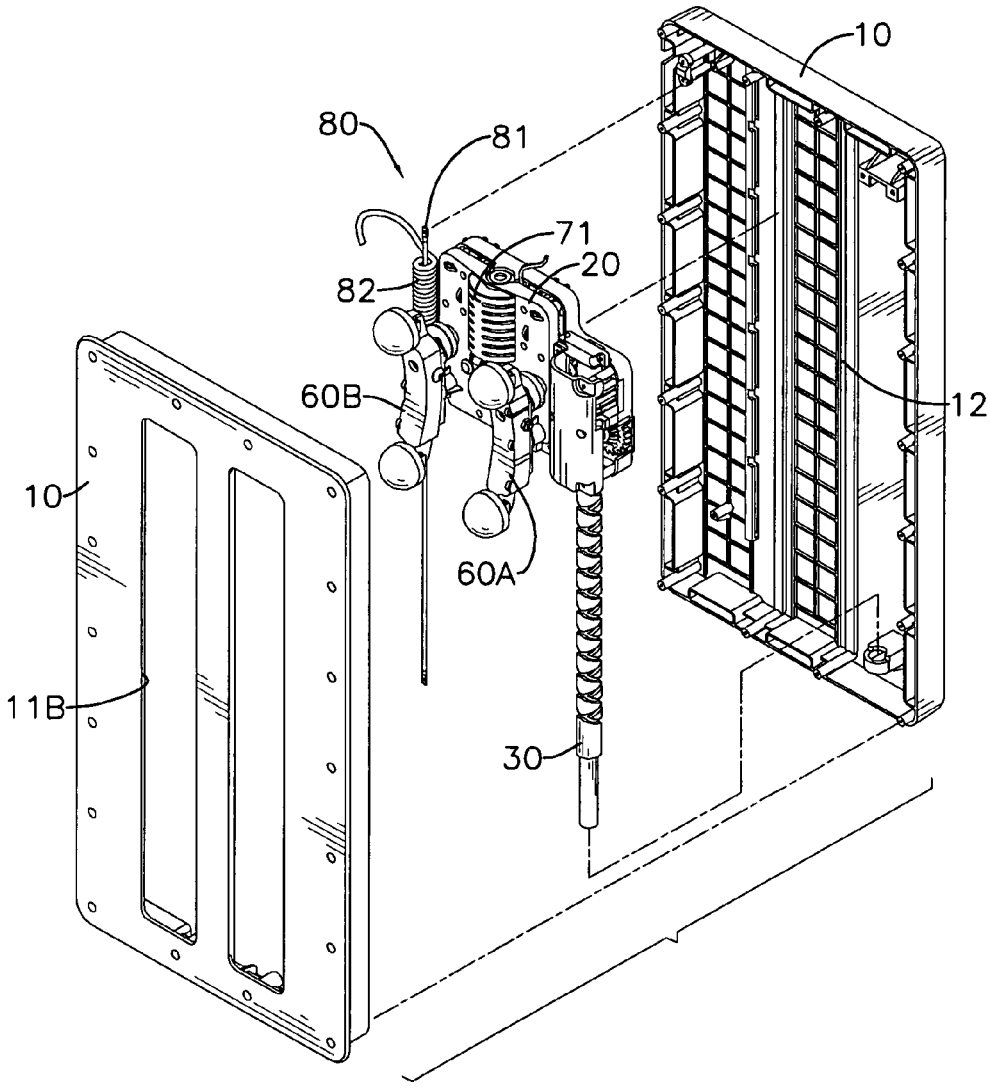
FIG. 2 is a partially exploded perspective view of the single-motor massager in FIG. 1.
Figure 3:
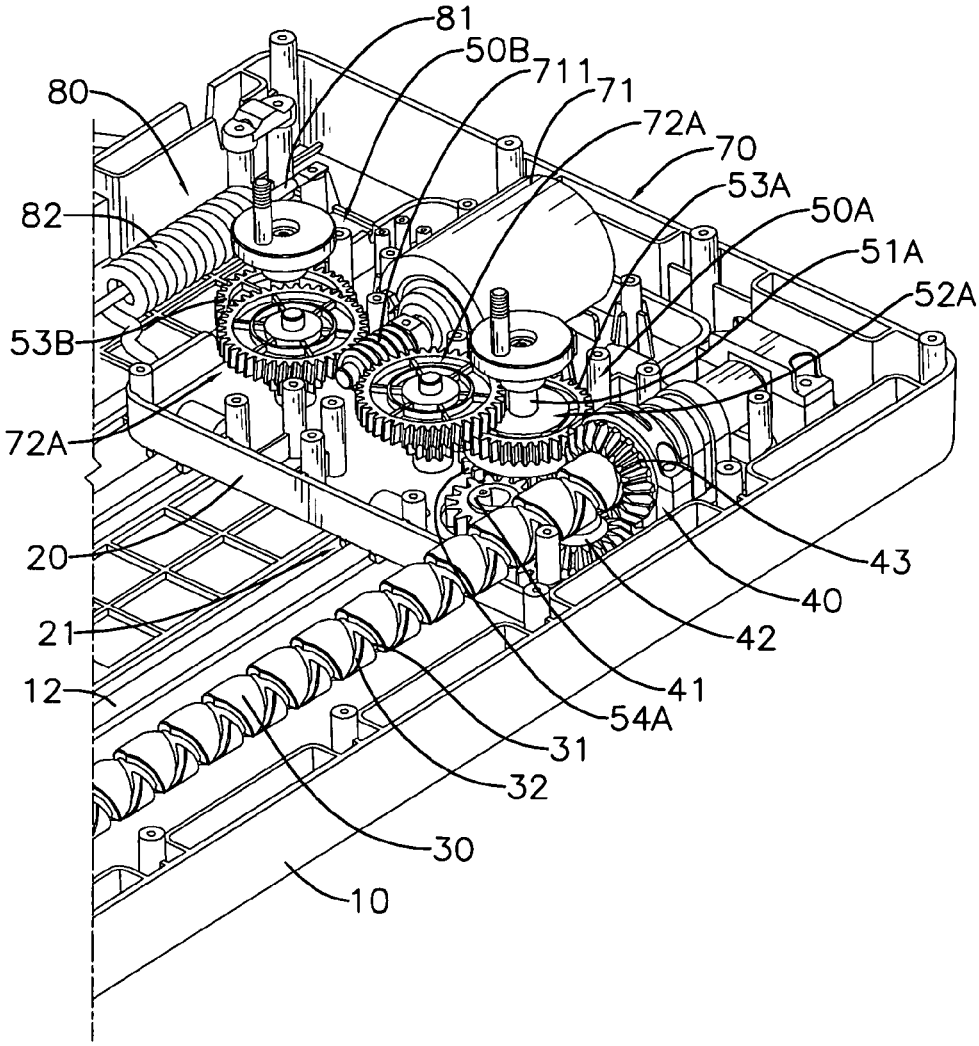
FIG. 3 is an enlarged perspective view of the single-motor massager in FIG. 1.

With reference to FIGS. 1, 2 and 3, a single-motor massager in accordance with the present invention comprises a housing (10), a carriage (20), a lead threaded rod (30), a guiding assembly (40), a main transmission assembly (50A), a secondary transmission assembly (50B), a main massage assembly (60A), a secondary massage assembly (60B), a driving assembly (70) and a revert assembly (80).

The housing (10) has a main guiding slot (11A), a secondary guiding slot (11B) and at least one track (12). The guiding slots (11A, 11B) are parallelly formed through a front surface of the housing (10). The at least one track (12) is formed on an inner bottom of the housing (10) and is parallel to the guiding slots (11A, 11B).

The carriage (20) is movably mounted in the housing (10) and has at least one holder (21). The at least one holder (21) is formed on an outer rear surface of the carriage (20) and holds the at least one track (12) of the housing (10) so the carriage (20) moves along the at least one track (12) in the housing (10).

The lead threaded rod (30) is mounted through the carriage (20), is parallel to the guiding slots (11A, 11B) of the housing (10) and has two ends, a right-handed thread (31) and a left-handed thread (32). The ends of the lead threaded rod (30) are securely attached to the housing (10). The right-handed thread (31) and the left-handed thread (32) are formed in and around the lead threaded rod (30) and interlace and communicate with each other.

Figure 4:
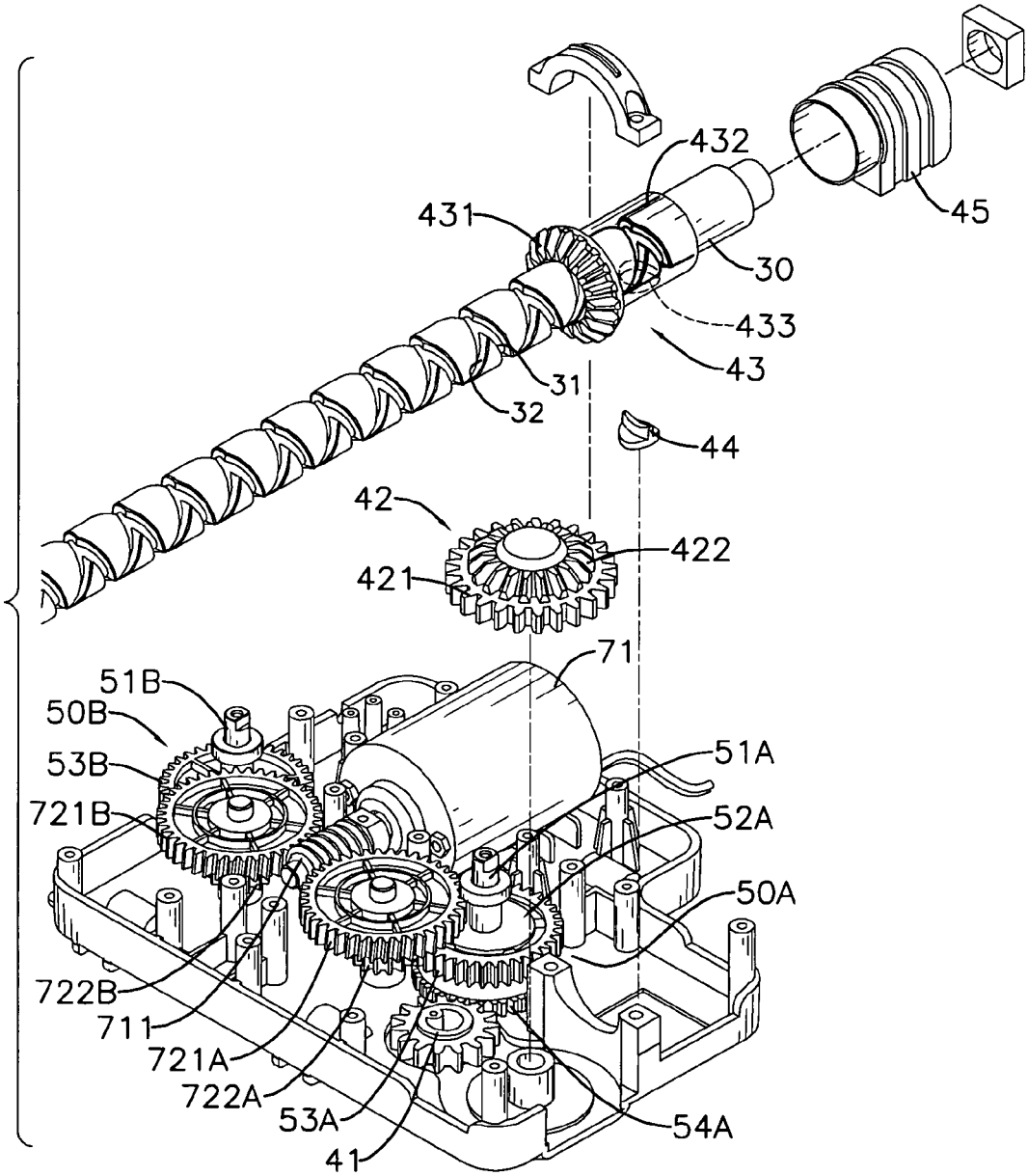
FIG. 4 is an enlarged partially exploded perspective view of the single-motor massager in FIG. 1.
Figure 5:
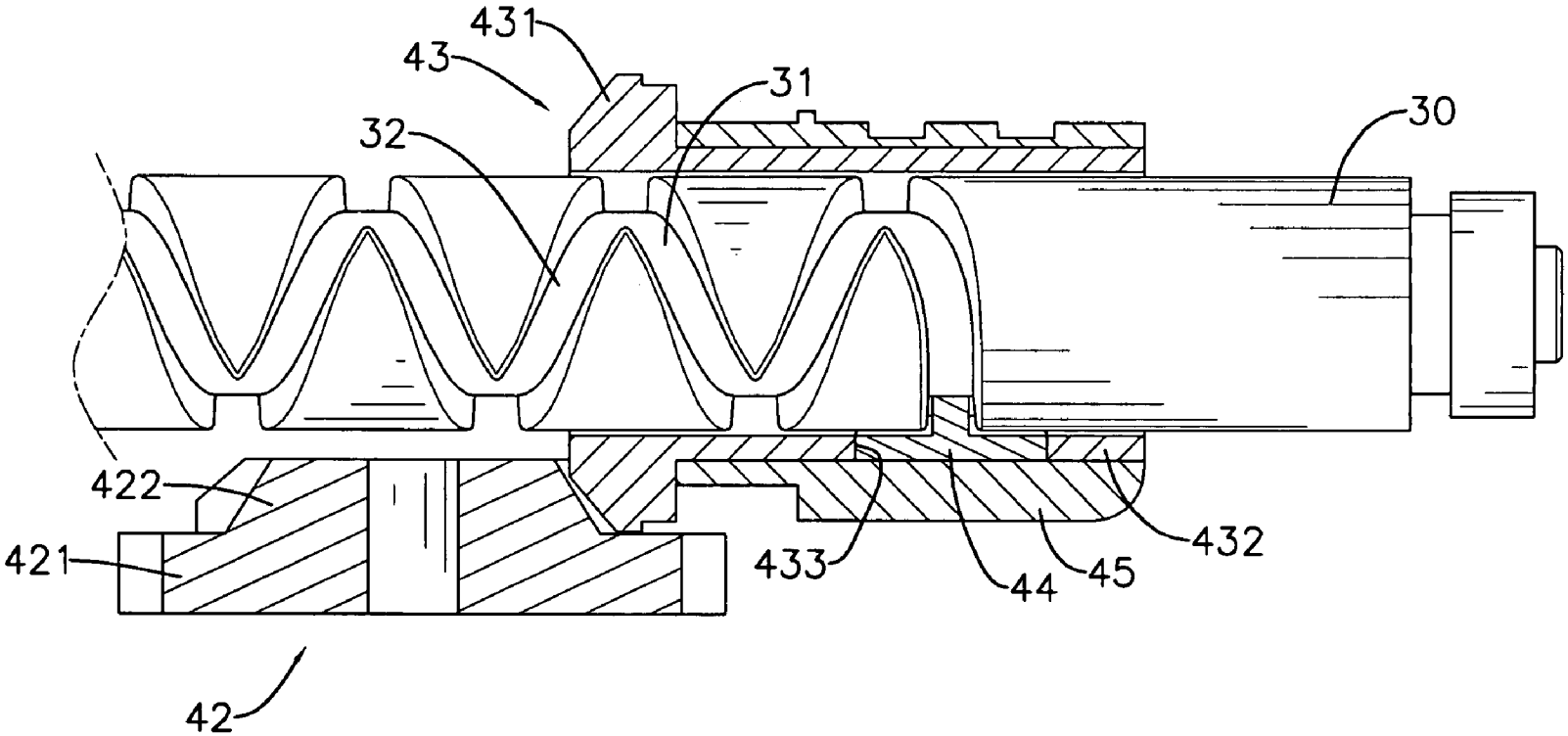

With further reference to FIG. 4, the guiding assembly (40) is mounted in the carriage (20) and has a transmission gear (41), a driving gear (42), a holding base (45), a driven element (43) and a guider (44).

The transmission gear (41) of the guiding assembly (40) is rotatably mounted in the carriage (20).

The driving gear (42) of the guiding assembly (40) is rotatably mounted in the carriage (20), engages the transmission gear (41) of the guiding assembly (40) and has an input gear (421) and an output gear (422). The input gear (421) of the driving gear (42) of the guiding assembly (40) engages the transmission gear (41) of the guiding assembly (40). The output gear (422) of the driving gear (42) of the guiding assembly (40) may be a bevel gear.

The holding base (45) is tubular, is securely mounted in the carriage (20) and is mounted around the lead threaded rod (30).

The driven element (43) of the guiding assembly (40) has a driven gear (431), a mounting tube (432) and a mounting hole (433). The driven gear (431) of the driven element (43) is mounted around the lead threaded rod (30), engages the output gear (422) of the driving gear (42) of the guiding assembly (40) and may be a bevel gear. The mounting tube (432) is formed on and protrudes axially from a side surface of the driven gear (431) of the driven element (43) and is rotatably mounted around the lead threaded rod (30) and through the holding base (45). The mounting hole (433) is formed through the mounting tube (431).

The guider (44) is securely mounted in the mounting hole (433) of the driven element (43), may be and alternatively engages the right-handed thread (31) and the left-handed thread (32) of the lead threaded rod (30).

The main transmission assembly (50A) is mounted in the carriage (20) and has a main shaft (51A), a one-way bearing (52A), a driven gear (53A) and a driving gear (54A).

The main shaft (51A) is rotatably mounted in the carriage (20) and has a distal end. The distal end of the main shaft (51A) protrudes through the carriage (20) and in the main guiding slot (11A) of the housing (10).

Figure 6:
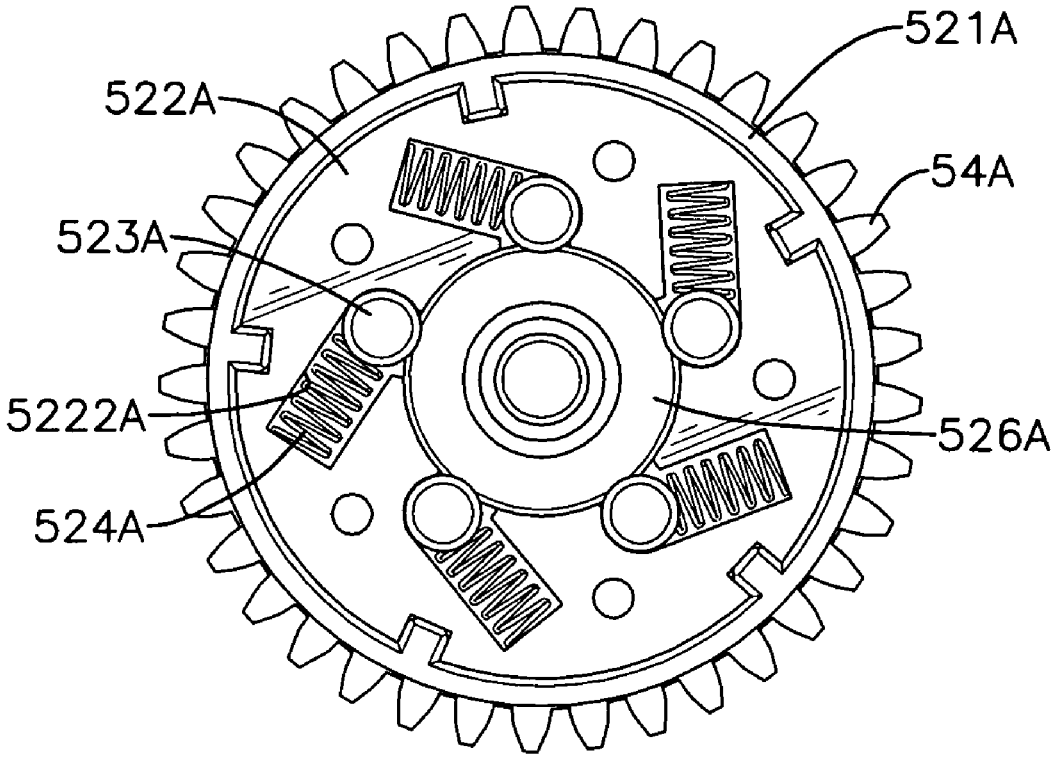
FIG. 6 is an upper view of a one-way bearing of the single-motor massager in FIG. 1, a cover of the one-way bearing being omitted.
Figure 7:
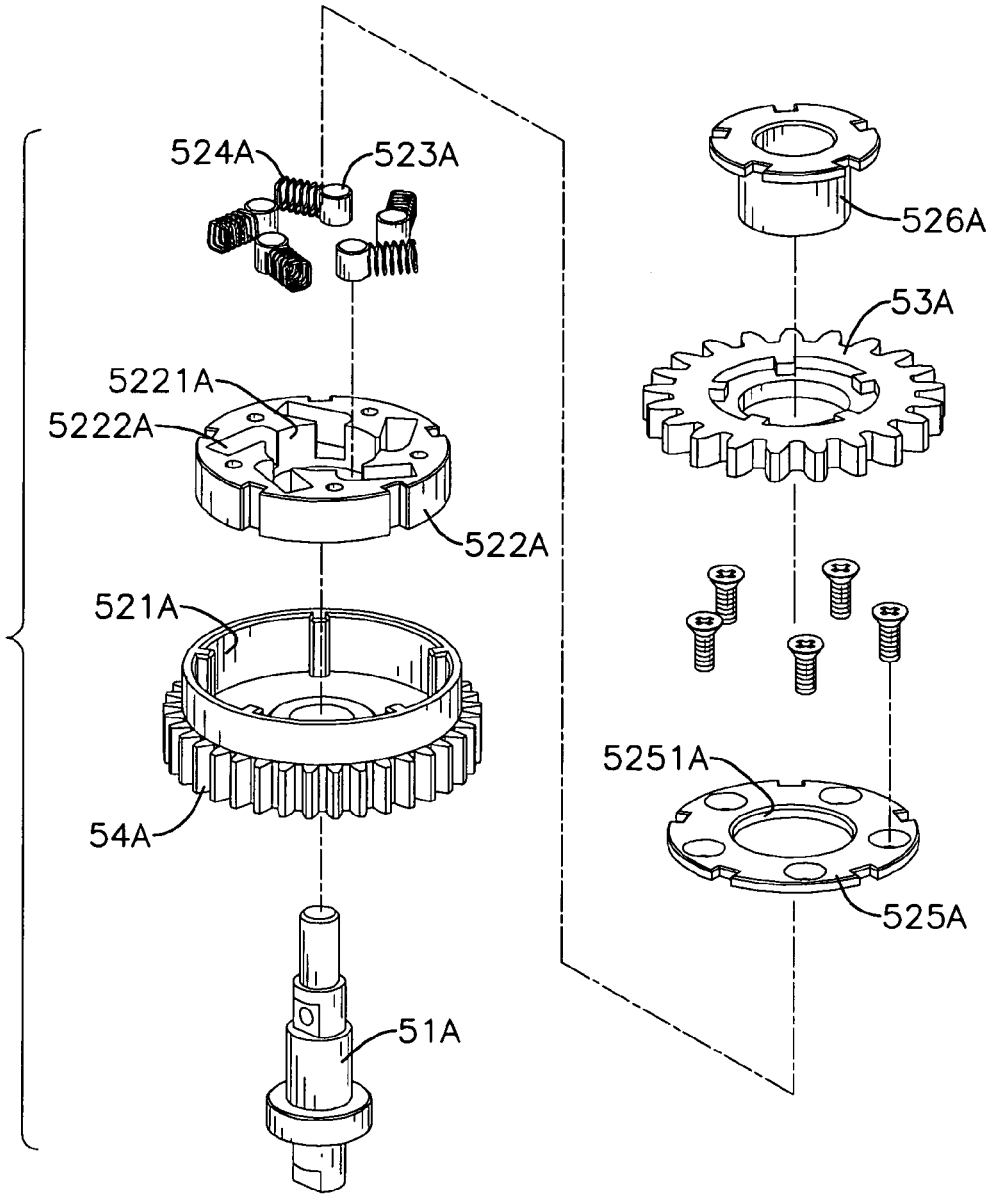
FIG. 7 is an exploded perspective view of a main transmission assembly of the single-motor massager in FIG. 1.

With further reference to FIGS. 6 and 7, the one-way bearing (52A) is securely mounted around the main shaft (51A) and has an outer casing (521A), a mounting base (522A), multiple pins (523A), multiple resilient elements (524A), a cover (525A) and a bushing (526A). The mounting base (522A) is securely mounted in the outer casing (521A) and has a central hole (5221A) and multiple mounting recesses (5222A). The central hole (5221A) of the mounting base (522A) is formed through the mounting base (522A). The mounting recesses (5222A) is formed in and around an upper surface of the mounting base (522A) and communicate with the central hole (5221A) of the mounting base (522A). The pins (523A) are respectively mounted in the mounting recesses (5222A) of the mounting base (522A). The resilient elements (524A) are respectively mounted in the mounting recesses (5222A) of the mounting base (522A). Each resilient element (524A) pushes a corresponding pin (523A) toward the central hole (5221A) of the mounting base (522A). The cover (525A) is securely mounted on the outer casing (521A), is attached to the mounting base (522A) and has a central hole (5251A). The central hole (5251A) of the cover (525A) is formed through the cover (525A) and corresponds to the central hole (5221A) of the mounting base (522A). The bushing (526A) is mounted through the central holes (5221A, 5251A) of the mounting base (522A) and the cover (525A), is securely attached to the main shaft (51A) and abuts the pins (523A). When the busing (526A) rotates relative to the outer casing (521A) in a direction, the pins (523A) hold the bushing (526A) and the outer casing (521A) rotates along with the bushing (526A). When the bushing (526A) rotates relative to the outer casing (521A) in another direction, the bushing (526A) pushes the pins (523A) and the outer casing (521A) does not rotate along with the bushing (526A).

The driven gear (53A) is mounted around the main shaft (51A) and is attached to the bushing (526A) of the one-way bearing (52A).

The driving gear (54A) is mounted around the main shaft (51A), is attached to the outer casing (521A) of the one-way bearing (52A), is connected to and drives the driven element (43) and may engage the transmission gear (41) of the guiding assembly (40).

The secondary transmission assembly (50B) is mounted in the carriage (20) and has a secondary shaft (51B) and a driven gear (53B). The secondary shaft (51B) is rotatably mounted in the carriage (20) and has a distal end. The distal end of the secondary shaft (51B) protrudes through the carriage (20) and in the secondary guiding slot (11B) of the housing (10). The driven gear (53B) of the secondary transmission assembly (50B) is securely mounted around the secondary shaft (51B).

The main massage assembly (60A) is disposed on the front surface of the housing (10) and is connected to the distal end of the main shaft (51A) and may be eccentric to the main shaft (51A).

The secondary massage assembly (60B) is disposed on the front surface of the housing (10) and is connected to the distal end of the secondary shaft (51B) and may be eccentric to the secondary shaft (51B).

The driving assembly (70) is mounted in the carriage (20) between the main and secondary transmission assemblies (50A, 50B) and has a motor (71), a main transmission gear (72A) and a secondary transmission gear (72B).

The motor (71) is securely mounted in the carriage (20) and has a worm (711). The worm (711) protrudes from an end of the motor (71) and is connected to and drives the driven gears (53A, 53B) of the main and secondary transmission assemblies (50A, 50B).

The main transmission gear (72A) is rotatably mounted in the carriage (20) between the worm (711) of the motor (71) and the main transmission assembly (50A) and has a driven gear (721A) and a transfer gear (722A). The driven gear (721A) of the main transmission gear (72A) engages the worm (711) of the motor (71). The transfer gear (722A) of the main transmission gear (72A) engages the driven gear (53A) of the main transmission assembly (50A).

The secondary transmission gear (72B) is rotatably mounted in the carriage (20) between the worm (711) of the motor (71) and the secondary transmission assembly (50B) and has a driven gear (721B) and a transfer gear (722B). The driven gear (721B) of the secondary transmission gear (72B) engages the worm (711) of the motor (71). The transfer gear (722B) of the secondary transmission gear (72B) engages the driven gear (53B) of the secondary transmission assembly (50B).

The revert assembly (80) is mounted in the housing (10) and has a mounting rod (81) and a resilient element (82). The mounting rod (81) is parallel to the lead threaded rod (30) and has two ends. The ends of the mounting rod (81) are securely attached to the housing (10). The resilient element (82) is mounted around the mounting rod (81) and is connected to the housing (10) and the carriage (20). When the carriage (20) moves back and forth along the at least one track (12) of the housing (10), the resilient element (82) of the revert assembly (80) pulls to assist the carriage (20) to return to an original position.

Figure 8:
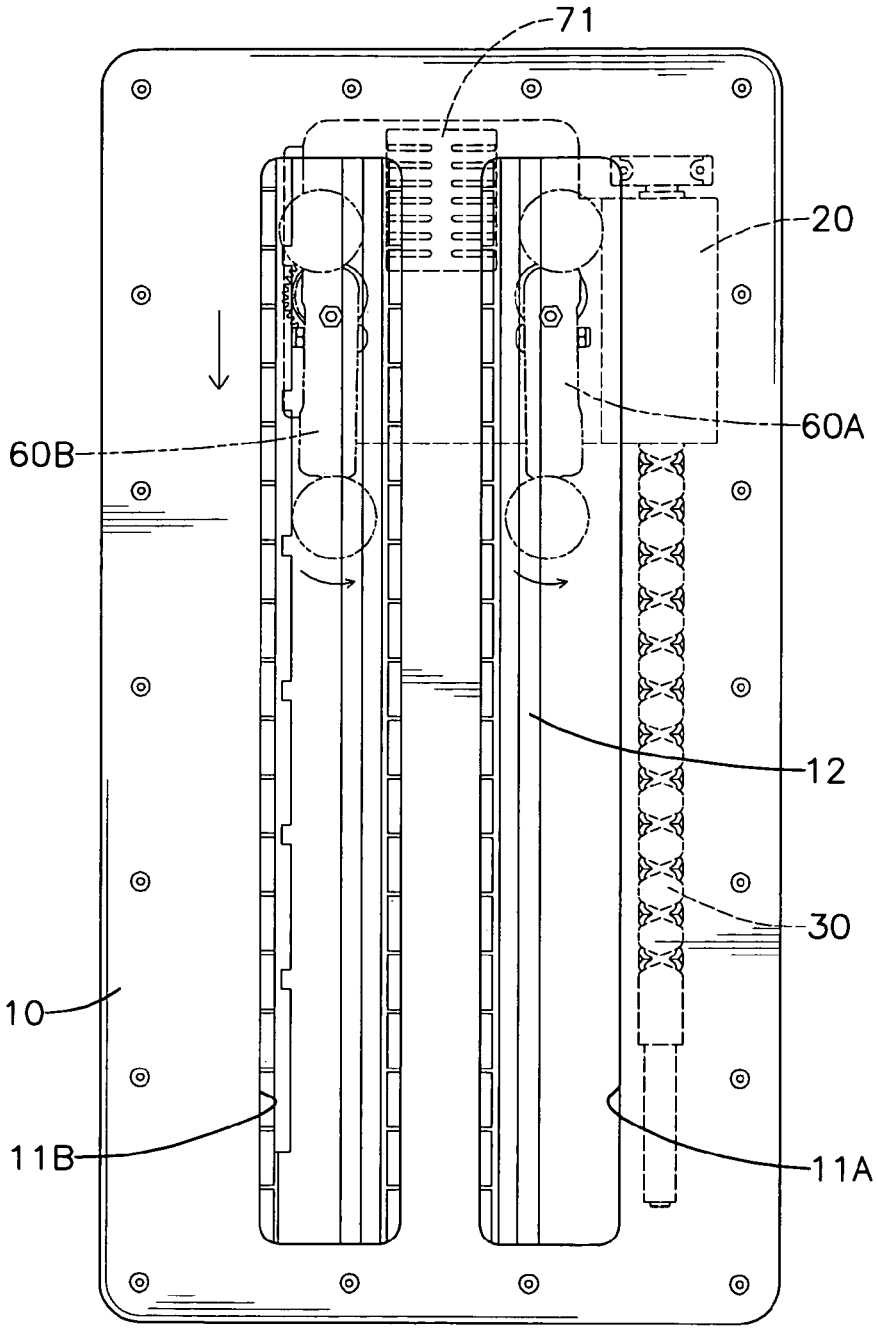
FIG. 8 is a front view of the single-motor massager in FIG. 1.
Figure 9:
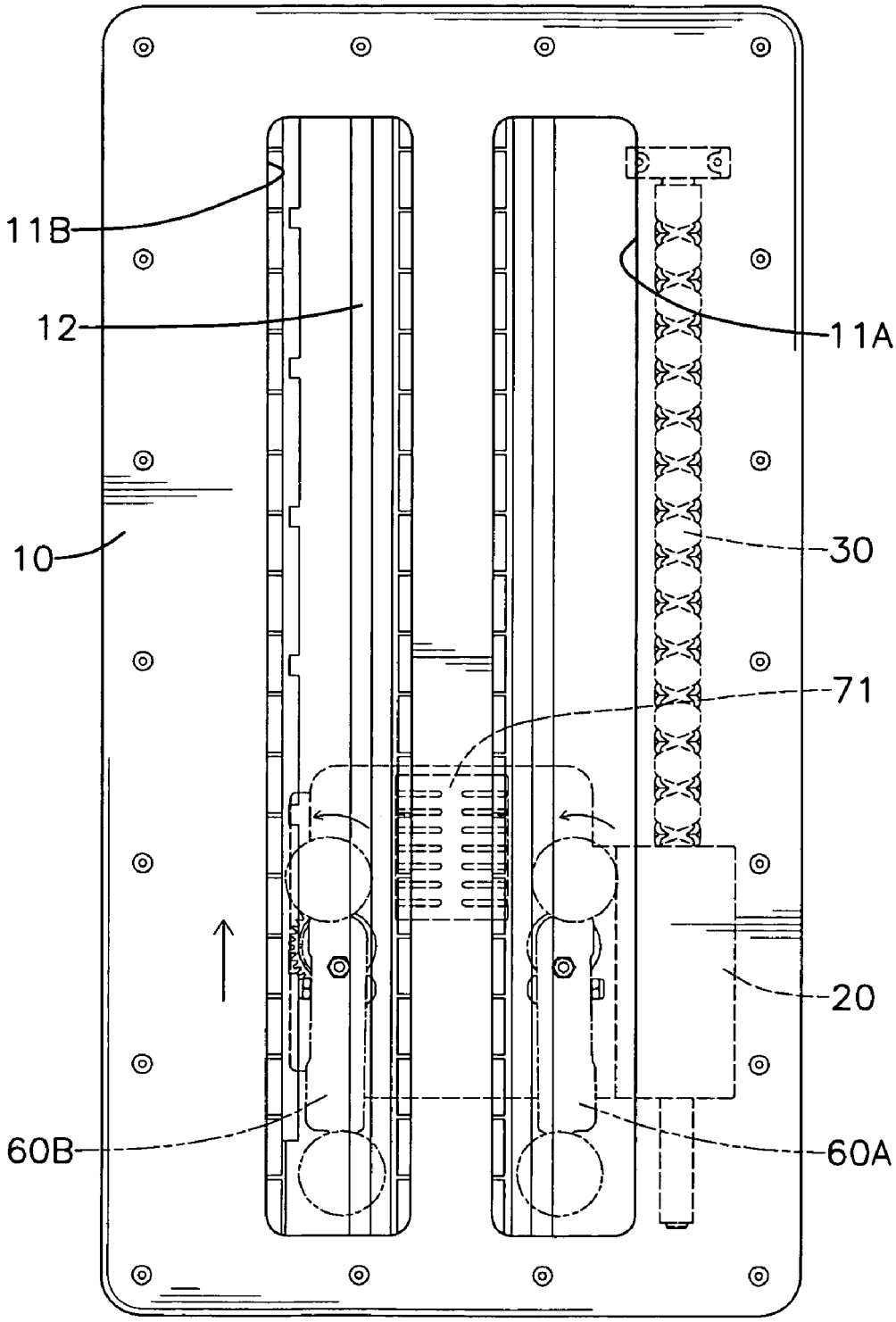
FIG. 9 is an operational front view of the single-motor massager in FIG. 1.

With further reference to FIGS. 8 and 9, when the motor (71) operates to rotate the worm (711) in one direction, the main and secondary transmission gears (72A, 72B) driven by the worm (711) drive and rotate the driven gears (53A, 53B) of the main and secondary transmission assemblies (50A, 50B), the main and secondary shafts (51A, 51B) and the main and secondary massage assemblies (60A, 60B) simultaneously so the massage assemblies (60A, 60B) provide massage functions. Furthermore, the main shaft (51A) drives the one-way bearing (52A) and the driving gear (54A) of the main transmission assembly (50A) to drive the transmission gear (41), the driving gear (42) and the driven element (43) of the guiding assembly (40). Thus, the guider (44) driven by the driven element (43) moves along the right-handed and left-handed threads (31, 32) of the lead threaded rod (30) so the carriage (20) and the guiding assembly (40), the transmission assemblies (50A, 50B), the massage assemblies (60A, 60B) and the driving assembly (70) mounted in the carriage (20) move back and forth along the lead threaded rod (30).

Figure 10:
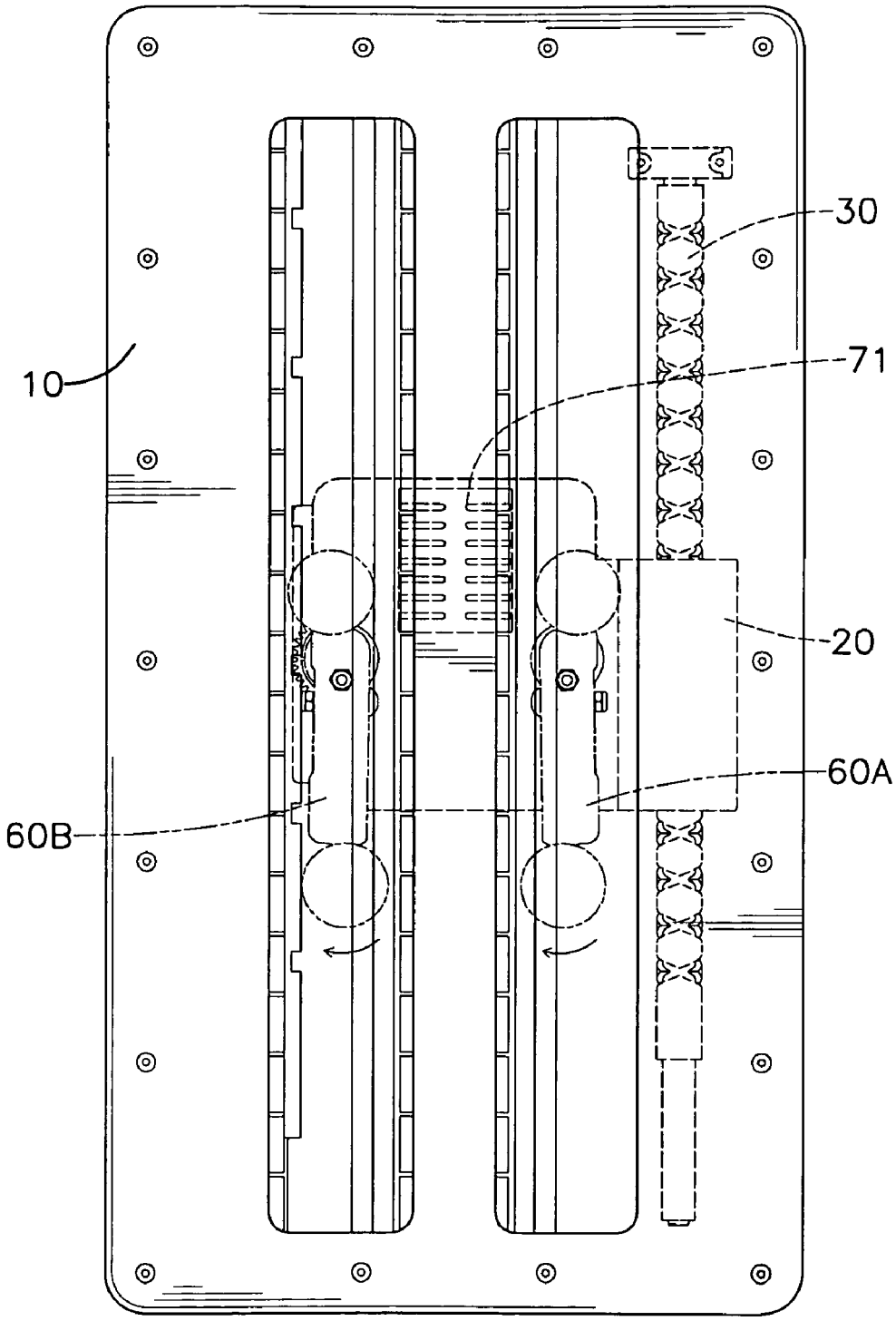
FIG. 10 is another operational front view of the single-motor massager in FIG. 1.
Figure 11:
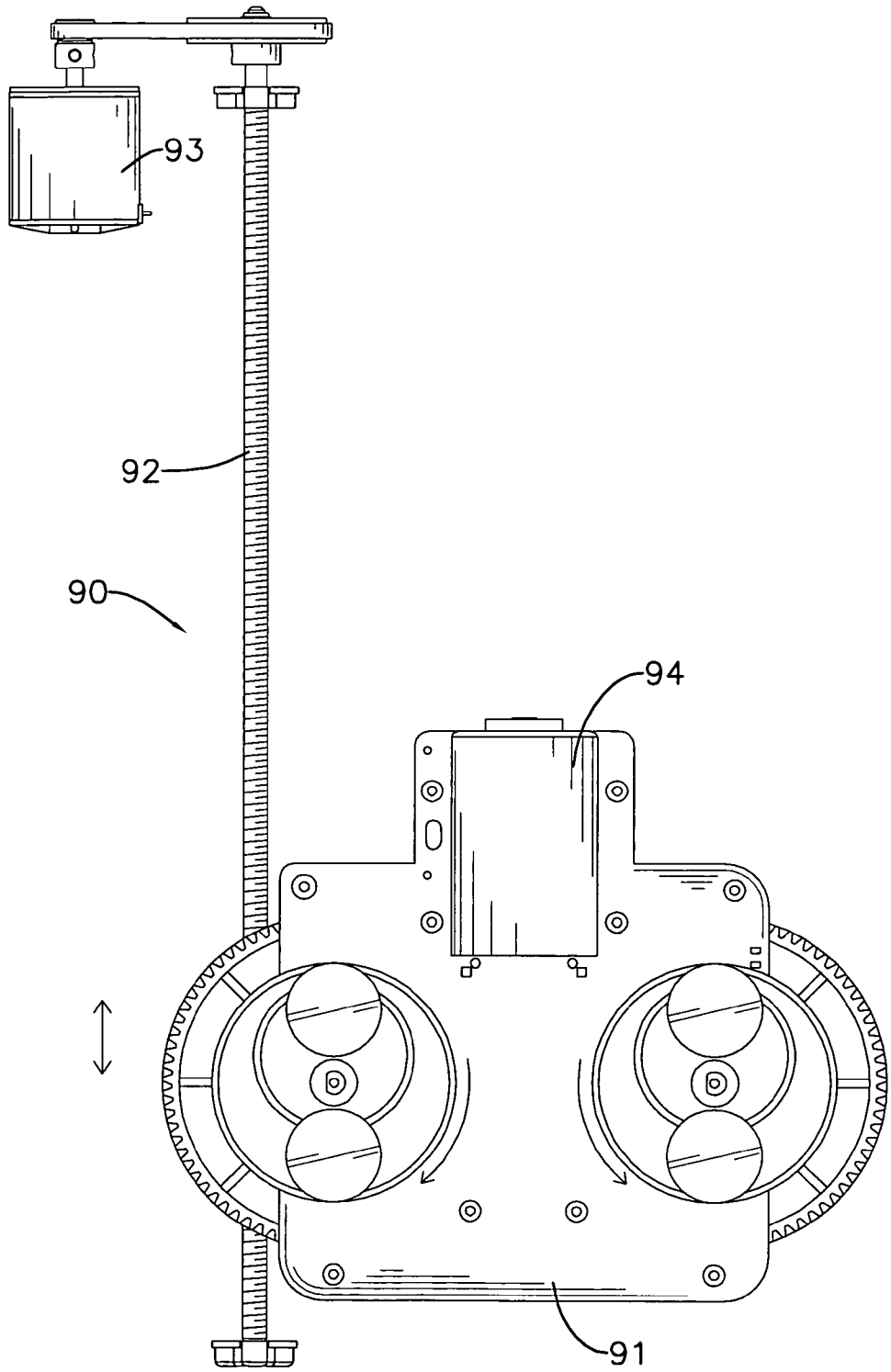
FIG. 11 PRIOR ART
FIG. 11 is a front view of a conventional massager in accordance with the prior art.

With further reference to FIG. 10, when the motor (71) is switched to rotate the worm (711) in a reverse direction, the main and secondary transmission gears (72A, 72B), the main and secondary shafts (51A, 51B) and the main and secondary massage assemblies (60A, 60B) also rotate in reverse direction. However, the outer casing (521A) of the one-way bearing (52) and the driving gear (54A) of the main transmission assembly (50A) does not rotate accordingly. Consequently, the guiding assembly (40) stops so the carriage (20) stops moving along the lead threaded rod (30).

The single-motor massager as described has the following advantages. The right-handed thread (31) and the left-handed thread (32) of the lead threaded rod (30) allow the carriage (20) and the massage assemblies (60A, 60B) to move back and forth along the lead threaded rod (30) to massage a large area of a operator's back. The one-way bearing (52A) allows the carriage (20) and the massage assemblies (60A, 60B) to stop at any position of the lead threaded rod (30) to focus on the massage function at a specific position. Therefore, the single-motor massager costs low, occupies small room and provides variety of massage functions.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A single-motor massager comprising a housing having a main guiding slot formed through a front surface of the housing; a carriage movably mounted in the housing; a lead threaded rod mounted through the carriage, being parallel to the main guiding slot of the housing and having two ends securely attached to the housing; a right-handed thread formed in and around the lead threaded rod; and a left-handed thread formed in and around the lead threaded rod and interlacing and communicating with the right-handed thread; a guiding assembly mounted in the carriage and having a holding base being tubular, securely mounted in the carriage and mounted around the lead threaded rod; a driven element having a first driven gear mounted around the lead threaded rod; a mounting tube formed on and protruding axially from a side surface of the driven gear of the driven element and rotatably mounted around the lead threaded rod and through the holding base; and a mounting hole formed through the mounting tube; and a guider securely mounted in the mounting hole of the driven element and alternatively engaging the right-handed thread and the left-handed thread of the lead threaded rod; a main transmission assembly mounted in the carriage and having a main shaft rotatably mounted in the carriage and having a distal end protruding through the carriage and in the main guiding slot of the housing; a one-way bearing securely mounted around the main shaft and having an outer casing; and a bushing securely attached to the main shaft; a second driven gear mounted around the main shaft and attached to the bushing of the one-way bearing; and a first driving gear mounted around the main shaft, attached to the outer casing of the one-way bearing and connected to and driving the first driven gear of the guiding assembly; a main massage assembly disposed on the front surface of the housing and connected to the distal end of the main shaft; and a driving assembly mounted in the carriage and having a motor securely mounted in the carriage and having a worm protruding from an end oft the motor and connected to and driving the second driven gear of the main transmission assembly.

2. The single-motor massager as claimed in claim 1, wherein the housing further has a secondary slot formed through the front surface of the housing and being parallel to the main guiding slot of the housing; the single-motor massager further comprises a secondary transmission assembly mounted in the carriage and having a secondary shaft rotatably mounted in the carriage and having a distal end protruding through the carriage and in the secondary guiding slot of the housing; and a third driven gear securely mounted around the secondary shaft; and a secondary massage assembly disposed on the front surface of the housing and connected to the distal end of the secondary shaft; the driving assembly is mounted between the main and secondary transmission assemblies; and the worm of the motor of the driving assembly is connected to and drives the third driven gear of the secondary transmission assembly.

3. The single-motor massager as claimed in claim 2, wherein the main massage assembly is eccentric to the main shaft; and the secondary massage assembly is eccentric to the secondary shaft.

4. The single-motor massager as claimed in claim 2, wherein the guiding assembly further has a transmission gear rotatably mounted in the carriage and engaging the transmission gear of the guiding assembly; and a second driving gear rotatably mounted in the carriage, engaging the transmission gear of the guiding assembly and having an input gear engaging the transmission gear of the guiding assembly; and an output gear engaging the first driven gear of the driven element of the guiding assembly.

5. The single-motor massager as claimed in claim 4, wherein the output gear of the driving gear and the driven gear of the driven element of the guiding assembly are bevel gears.

6. The single-motor massager as claimed in claim 4, wherein the driving assembly further has a main transmission gear rotatably mounted in the carriage between the worm of the motor and the main transmission assembly and having a fourth driven gear engaging the worm of the motor; and a transfer gear engaging the second driven gear of the main transmission assembly; and a secondary transmission gear rotatably mounted in the carriage between the worm of the motor and the secondary transmission assembly and having a fifth driven gear engaging the worm of the motor; and a transfer gear engaging the third driven gear of the secondary transmission assembly.

7. The single-motor massager as claimed in claim 6, wherein the housing further has at least one track formed on an inner bottom of the housing and being parallel to the main guiding slot of the housing; and the carriage further has at least one holder formed on an outer rear surface of the carriage and holding the at least one track of the housing.

8. The single-motor massager as claimed in claim 7 further comprising a revert assembly mounted in the housing and having a mounting rod being parallel to the lead threaded rod and having two ends securely attached to the housing; and a resilient element mounted around the mounting rod and connected to the housing and the carriage.

9. The single-motor massager as claimed in claim 8, wherein the one-way bearing of the main transmission assembly further has a mounting base securely mounted in the outer casing of the one-way bearing and having a central hole formed through the mounting base; and multiple mounting recesses formed in and around an upper surface of the mounting base and communicating with the central hole of the mounting base;

multiple pins respectively mounted in the mounting recesses of the mounting base;

multiple resilient elements respectively mounted in the mounting recesses of the mounting base, and each resilient element pushes a corresponding pin toward the central hole of the mounting base; and a cover securely mounted on the outer casing, attached to the mounting base and having a central hole formed through the cover and corresponding to the central hole of the mounting base;

the bushing of the one-way bearing is mounted through the central holes of the mounting base and the cover and abuts the pins.

10. The single-motor massager as claimed in claim 1, wherein the guiding assembly further has a transmission gear rotatably mounted in the carriage and engaging the transmission gear of the guiding assembly; and a second driving gear rotatably mounted in the carriage, engaging the 16 transmission gear of the guiding assembly and having an input gear engaging the transmission gear of the guiding assembly; and an output gear engaging the driven gear of the driven element of the guiding assembly.

11. The single-motor massager as claimed in claim 10, wherein the output gear of the driving gear and the driven gear of the driven element of the guiding assembly are bevel gears.

12. The single-motor massager as claimed in claim 10, wherein the driving assembly further has a main transmission gear rotatably mounted in the carriage between the worm of the motor and the main transmission assembly and having a fourth driven gear engaging the worm of the motor; and a transfer gear engaging the second driven gear of the main transmission assembly.

13. The single-motor massager as claimed in claim 12, wherein the housing further has at least one track formed on an inner bottom of the housing and being parallel to the main guiding slot of the housing; and the carriage further has at least one holder formed on an outer rear surface of the carriage and holding the at least one track of the housing.

14. The single-motor massager as claimed in claim 13 further comprising a revert assembly mounted in the housing and having a mounting rod being parallel to the lead threaded rod and having two ends securely attached to the housing; and a resilient element mounted around the mounting rod and connected to the housing and the carriage.

15. The single-motor massager as claimed in claim 14, wherein the one-way bearing of the main transmission assembly further has a mounting base securely mounted in the outer casing of the one-way bearing and having a central hole formed through the mounting base; and multiple mounting recesses formed in and around an upper surface of the mounting base and communicating with the central hole of the mounting base;

multiple pins respectively mounted in the mounting recesses of the mounting base;

multiple resilient elements respectively mounted in the mounting recesses of the mounting base, and each resilient element pushes a corresponding pin toward the central hole of the mounting base; and a cover securely mounted on the outer casing, attached to the mounting base and having a central hole formed through the cover and corresponding to the central hole of the mounting base;

the bushing of the one-way bearing is mounted through the central holes of the mounting base and the cover and abuts the pins.

16. The single-motor massager as claimed in claim 1, wherein the main massage assembly is eccentric to the main shaft.

* * * * *